US006513553B2

(12) United States Patent
Lennartsson

(10) Patent No.: US 6,513,553 B2
(45) **Date of Patent: *Feb. 4, 2003**

(54) HELICALLY WOUND LOCK-SEAM TUBE

(75) Inventor: Kenneth Lennartsson, Torekov (SE)

(73) Assignee: Protol A.G., Glarus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/788,858

(22) Filed: Feb. 20, 2001

(65) Prior Publication Data

US 2001/0013375 A1 Aug. 16, 2001

Related U.S. Application Data

(62) Division of application No. 09/548,881, filed on Apr. 13, 2000, which is a division of application No. 09/219,239, filed on Dec. 22, 1998, now Pat. No. 6,085,801, which is a division of application No. 08/925,545, filed on Sep. 8, 1997, now Pat. No. 6,003,220, which is a division of application No. 08/747,998, filed on Nov. 12, 1996, now Pat. No. 5,720,095, which is a continuation of application No. 08/400,752, filed on Mar. 8, 1995, now abandoned.

(51) Int. Cl.[7] ..... F16L 9/16
(52) U.S. Cl. ..... 138/154; 29/509
(58) Field of Search ..... 138/154, 170; 72/49, 50, 367.1, 368, 370.19; 29/505, 509, 521, 243.5, 243.517, 243.518, 243.58

(56) References Cited

U.S. PATENT DOCUMENTS

| | | | | |
|---|---|---|---|---|
| 192,079 A | | 6/1877 | Noble | 138/154 |
| 224,228 A | | 2/1880 | Ritchie | 138/154 |
| 470,738 A | | 3/1892 | Bayles | 138/154 |
| 683,519 A | | 10/1901 | Taylor | 138/154 |
| 1,718,983 A | | 7/1929 | Schneible | |
| 2,339,219 A | | 1/1944 | Crowley | 113/35 |
| 2,888,043 A | | 5/1959 | Reid | 138/144 |
| D213,828 S | | 4/1969 | Blake | D23/266 |
| 3,546,910 A | | 12/1970 | Jensen | |
| 3,604,464 A | | 9/1971 | Pelley | 138/154 |
| 3,677,046 A | | 7/1972 | Carroll | 72/49 |
| 3,940,962 A | | 3/1976 | Davis | 72/50 |
| 4,706,481 A | | 11/1987 | Castricum | 72/49 |
| D296,355 S | | 6/1988 | Kanao | D23/266 |
| 5,383,346 A | | 1/1995 | Laffler et al. | 72/51 |
| 6,085,801 A | * | 7/2000 | Lennartsson | 138/154 |

FOREIGN PATENT DOCUMENTS

| | | | |
|---|---|---|---|
| JP | 22729 | 10/1965 | 72/50 |

* cited by examiner

*Primary Examiner*—David P. Bryant
(74) *Attorney, Agent, or Firm*—Weingarten, Schurgin. Gagnebin & Lebovici LLP

(57) ABSTRACT

In a method for producing helically wound lock-seam tubing, a metal strip is fed to a forming head in which the tubing is formed. In order to prevent lock-seam slip, a clinching roller device form interlocking spaced deformations on the lock-seam. An apparatus for such production comprises a clinching roller provided with a recess for forming the deformations against a counter roller.

8 Claims, 7 Drawing Sheets

HELICALLY WOUND LOCK-SEAM TUBE

CROSS-REFERENCE TO RELATED APPLICATIONS

This application is a divisional of application Ser. No. 09/548,881, filed Apr. 13, 2000, which is a divisional of application Ser. No. 09/219,239, filed Dec. 22, 1998, now U.S. Pat. No. 6,085,801 which is a divisional of application Ser. No. 08/925,545, filed Sep. 8, 1997, now U.S. Pat. No. 6,003,220, which is a divisional of application Ser. No. 08/747,998, filed Nov. 12, 1996, now U.S. Pat. No. 5,720, 095, which is a continuation of application Ser. No. 08/400, 752, filed Mar. 8, 1995, now abandoned.

FIELD OF THE INVENTION

The present invention relates to the production of helically wound tubing, and more specifically to a method and an apparatus for producing helically wound lock-seam tubing from a strip of sheet metal. The tubing can, for example, be used in ventilation duct systems.

BACKGROUND ART

A known machine for producing helically wound lock-seam tubing is disclosed in British patent publication GB 2,213,748 (see FIG. 1) which is incorporated herein by reference. In this machine, a metal strip is fed to a forming head by means of drive rollers, and a helically wound lock-seam tube is formed by clinching rollers associated with the forming head.

Another known machine for producing helically wound tubing is disclosed in British patent specification GB 1,168, 178, wherein FIGS. 3 and 4 show different seams.

The technology related to such machines is well-known to persons skilled in the art. At present, several further developed machines of a similar type are available on the market. However, these machines still suffer from some specific drawbacks.

In the production of helically wound lock-seam tubes of the present type, the lock-seam tends to slip, which results in an undesirable change in tube diameter. The general solution to this problem is to increase the pressure of the clinching rollers acting on the lock-seam in the forming head. However, such an increased clinching pressure can cause damage to and deficiencies in the lock-seam as well as in the adjacent portions of the metal strip forming the tube. Thus, the adjustment of the clinching pressure is crucial to the quality of the lock- In addition to the clinching pressure, the operator running the machine must consider several other parameters, such as the thickness of the metal strip, the lubrication of the same, and possible wear of different machine components, for example the rollers. Thus, great demands are made on the skill and experience of the operator.

In spite of the operator's skill, it is hard to avoid slip or sliding in the lock-seam. An undesirable increase of the tube diameter can occur either in production, immediately after the forming head, or during storing, handling and transportation of the tubes. It should be noted that the tube diameter may also be undesirably reduced due to lock-seam slip, for example when tubes are subject to pressure forces from the outside.

The change in tube diameter is always a problem, since the tubes delivered do not fulfil the customers' specifications and requirements.

Specific problems are encountered when using the tubes in ventilation duct systems mounted on different premises.

For example, vibrations caused by fans and similar equipment can initiate lock-seam slip which, in turn, leads to undesirable leakage of air and pressure drops. In severe cases, lock-seam slip of the ventilation ducts can jeopardize safe function of the whole ventilation system.

In ventilation duct systems, different fittings are connected to the helically wound lock-seam tubes forming the major part of the system. Such fittings are bends, T-pieces, dampers, sound attenuators, etc. The fittings are normally inserted in the end of the tubes, and a sealing ring on the inserted portion of the fitting ensures safe sealing. However, if the tube has an undesirably increased diameter, there is a risk that sufficient sealing cannot be obtained in the joint between the fitting and the tube. This may lead to the leakage and pressure drop problems discussed above, resulting in energy losses and increased running costs.

In other cases, the fitting is not provided with a pre-mounted seal, but the joint between the outside of the fitting and the inside of the tube is filled with a mastic for sealing purposes. If the gap is too large due to an undesirable increased tube diameter, sufficient sealing may not be obtained by means of the mastic. Even if the mastic is safely fastened, problems may arise later due to increased tube diameter caused by vibrations, air pressure peaks, etc.

Further, change in tube diameter is disadvantageous when prefabricated annular fastening devices and the like are to be applied on the outside of the tube. Such devices do not fit if the tube diameter has changed.

SUMMARY OF THE INVENTION

One object of the present invention is to remedy the above-mentioned drawbacks by providing a method and an apparatus for producing helically wound lock-seam tubing with no or very low risk of lock-seam slip or sliding in any direction.

Another object of the present invention is to provide a method and an apparatus for producing helically wound lock-seam tubes which maintain their diameter during storing, handling, transportation, delivery and mounting on the final site.

A specific object of the invention is to provide a method and an apparatus which are easily adapted to existing machines.

These objects are achieved by a method for producing helically wound lock-seam tubing from metal strip having longitudinal edge portions. The method comprises the following steps: feeding the strip to a forming head; forming the strip into a helical form in the forming head, whereby the edge portions of the helically formed strip are brought into engagement with each other; clinching the engaging edge portions of the strip to form a helically wound lock-seam on a tube formed in the forming head; and feeding the helically wound lock-seam tube out of the forming head. In order to interlock the engaging edge portions of the strip in the lock-seam, the method further comprises the step of providing spaced deformations on the lock-seam.

The objects are also achieved by an apparatus for producing helically wound lock-seam tubing from metal strip having longitudinal edge portions. The apparatus comprises: means for feeding the strip to a forming head; means for forming the strip into helical form in the forming head and for bringing the edge portions of the helically formed strip into engagement with each other; a clinching assembly for clinching said engaging edge portions of the strip to form a helically wound lock-seam on a tube formed in the forming head; and means for feeding the helically wound lock-seam tube out of the forming head. In order to interlock the engaging edge portions of the strip in the lock-seam, the apparatus further comprises means for providing spaced deformations on the lock-seam.

The invention makes it possible to avoid lock-seam slip and achieve further advantages.

An important advantage is that the spaced deformations on the lock-seam immediately indicate that the tube in question has a securely interlocked lock-seam which in turn results in a constant diameter of the tube.

Another advantage is that the means for providing the interlocking deformations can either be incorporated in new machines or easily mounted on existing machines as additional equipment.

BRIEF DESCRIPTION OF THE DRAWINGS

The invention will now be described with reference to the accompanying schematic drawings showing preferred embodiments by way of example.

DESCRIPTION OF PREFERRED EMBODIMENTS

Figure 1:
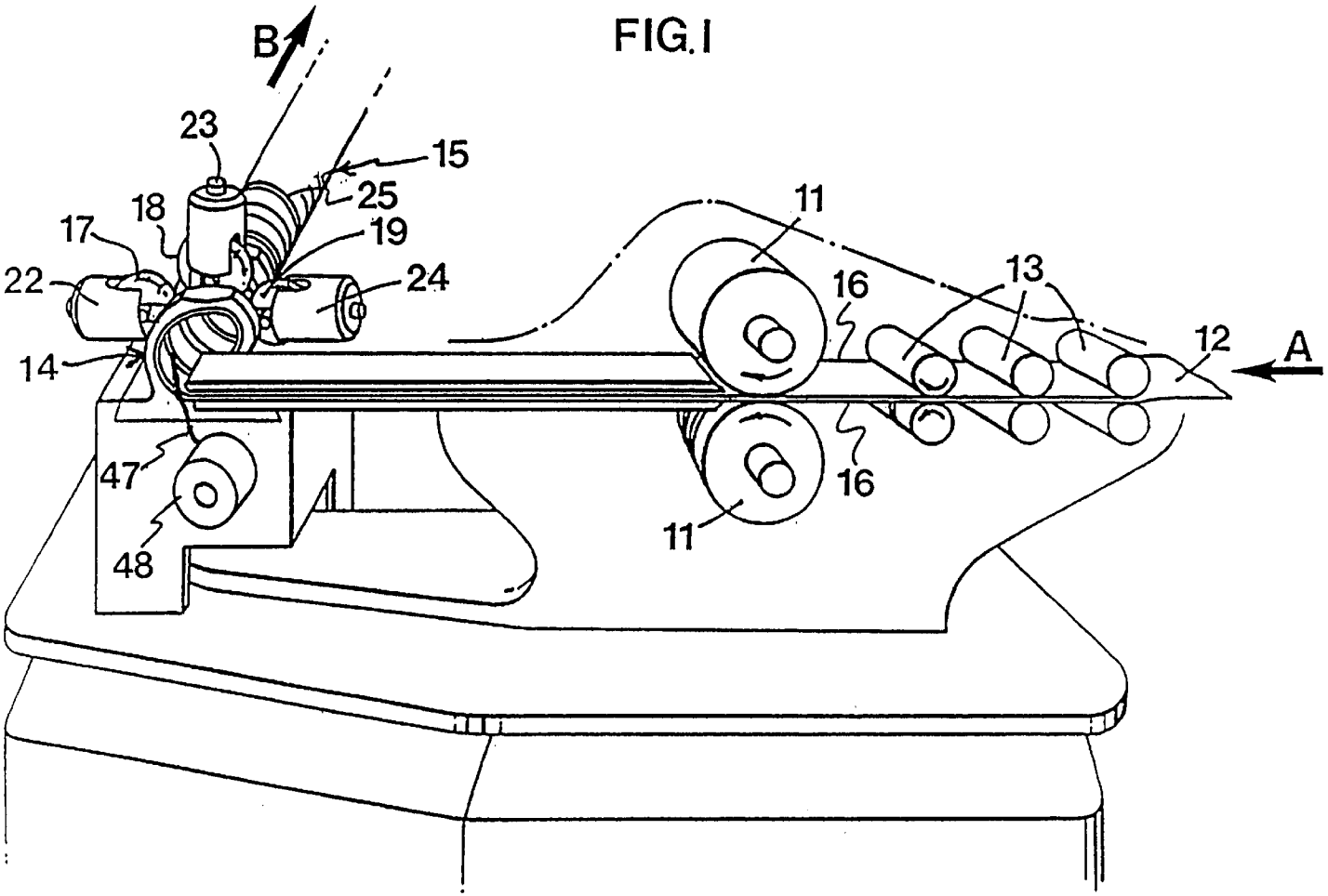
FIG. 1 illustrates schematically a prior art machine for producing helically wound lock-seam tubing.

The method and the apparatus according to the invention can in principle be applied to a machine of the type as generally shown in FIG. 1. This known machine corresponds to the machine described in the publication GB-A-2,213,748 mentioned by way of introduction. A metal strip 12 is fed to a forming head 14 by drive rollers 11 (arrow A). The longitudinal edge portions 16 of the strip 12 can be preformed in a known manner by rollers 13. In the forming head 14, the strip 12 is formed into a helical shape, whereby the edge portions 16 are brought into engagement with each other. A clinching assembly 22, 23, 24 is associated with the forming head 14 and includes clinching rollers 17, 18, 19 for clinching the engaging edge portions 16 of the strip 12 to form a helically wound lock-seam 25 on a tube generally denoted 15. In production, the tube 15 is positively fed out of the forming head 14 in a direction shown with an arrow B by the in-feeding force of the strip 12. The tube 15 is cut to desired lengths by a cutting device (not shown).

Figure 2:
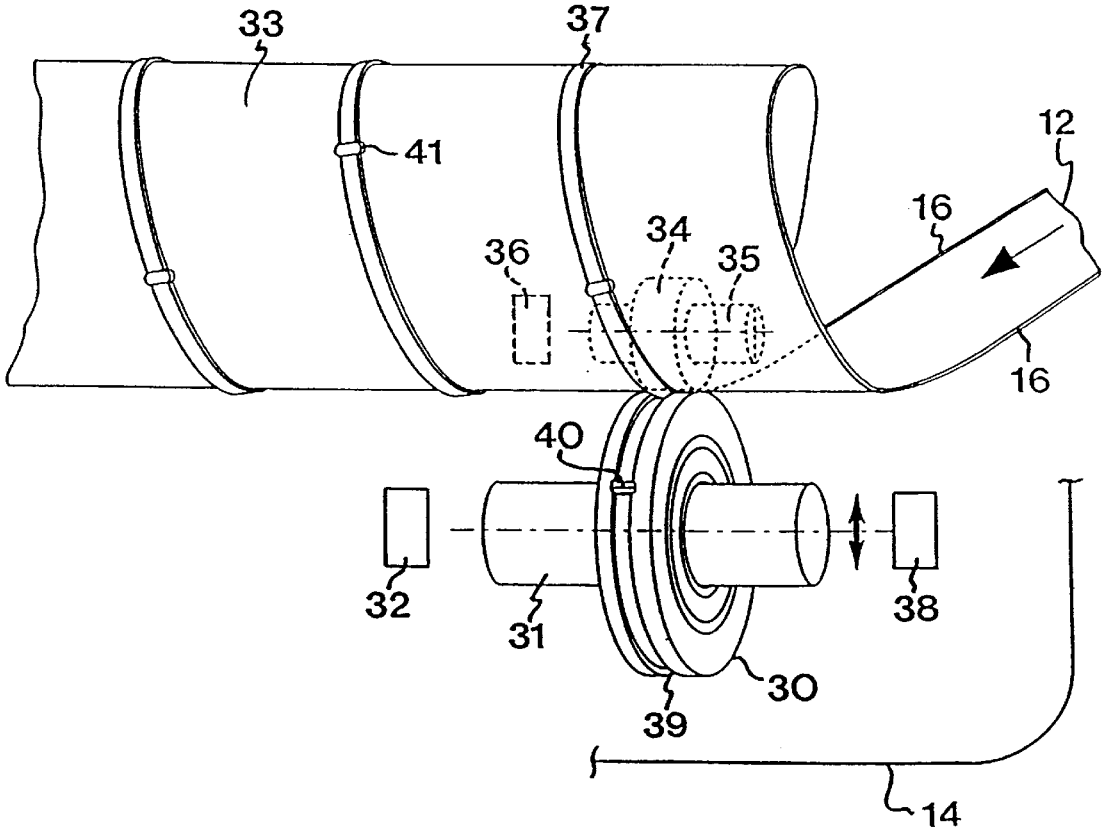
FIG. 2 illustrates schematically a clinching device incorporated in a machine according to the present invention.

The machine shown in FIG. 1 can be improved by means of a clinching device of the type illustrated in FIG. 2. This clinching device can be mounted either in or in connection with the forming head 14. The clinching device according to a first embodiment comprises a clinching roller 30 having a shaft 31 which is rotatably supported by bearings 32 (schematically shown) mounted on the forming head 14 (cf. FIG. 1). A counter roller 34 having a shaft 35 which is rotatably supported by bearings 36 (schematically shown) mounted on the forming head 14 (cf. FIG. 1) is located inside a tube 33. A lock-seam 37 of the tube 33 is clinched between the peripheries of the two rollers 30, 34 at a clinching point. The clinching pressure is adjustable by a device 38 (schematically shown) acting on the shaft 31 in the directions of the arrows.

The clinching roller 30 has a peripheral groove 39 with a transverse recess 40 (see FIGS. 6–9). At the clinching point between the two rollers 30, 34, this recess 40 forms interlocking deformations 41 on the lock-seam 37.

The device shown in FIG. 2 works as follows. A metal strip 12 with longitudinal edge portions 16, which may be preformed by rollers 13 (cf. FIG. 1), is formed in the forming head 14. In order to avoid slip in the lock-seam, the engaging edge portions 16 are deformed and interlocked by the deformations 41 formed by the recess 40 of the clinching roller 30. In the first embodiment shown in FIG. 2, the spaced deformations 41 are in the shape of expanded portions of the lock-seam 37. In this way, the engaging edge portions 16 are fixed together in the lock-seam 37, which in turn results in a tube 33 with a constant diameter. Slip in the lock-seam 37 is prevented.

Figure 5:
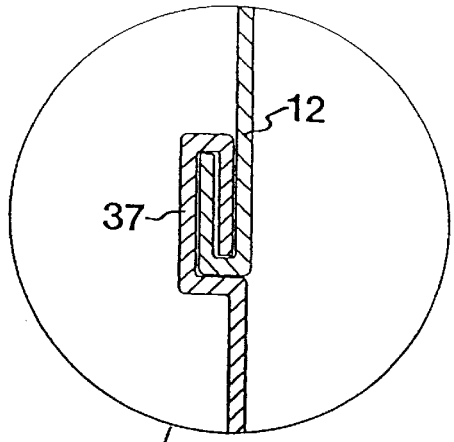
FIG. 5 shows, on a larger scale, a cross-section of the lock-seam shown in FIG. 3.
Figure 3:
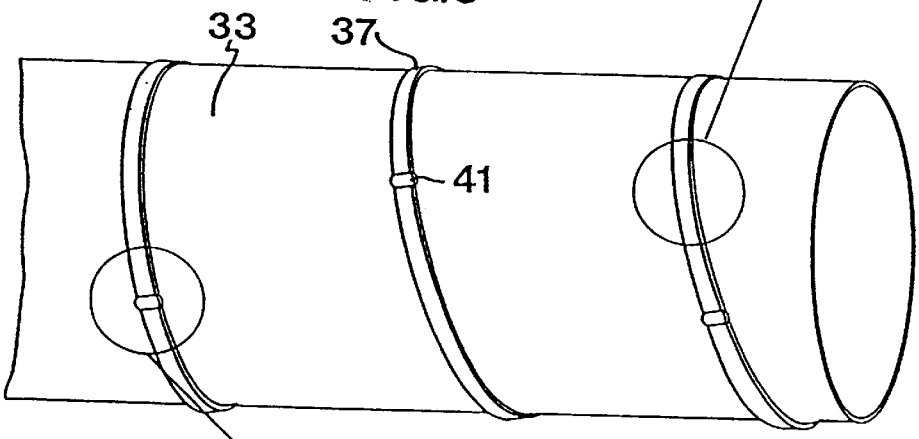
FIG. 3 shows a helically wound lock-seam tube produced by a method and an apparatus according to the present invention.
Figure 4:
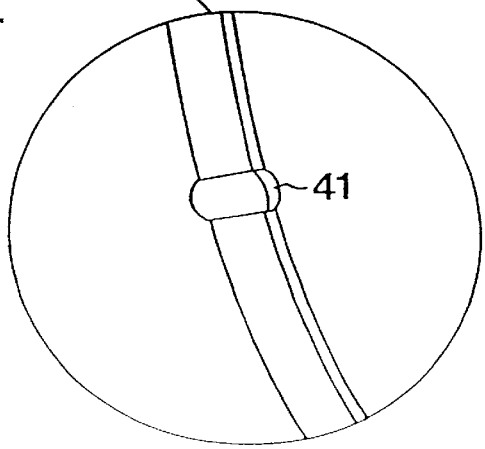
FIG. 4 shows, on a larger scale, a lock-seam of the tube shown in FIG. 3.
Figure 6:
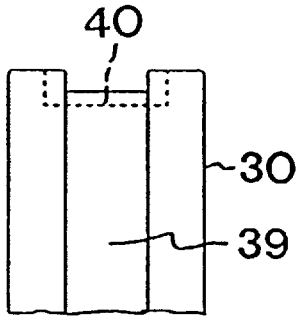
FIG. 6 is a partial view of an embodiment of a clinching roller.
Figure 7:
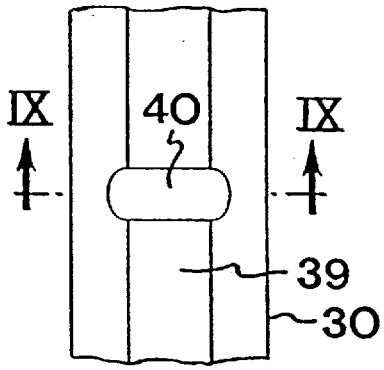
FIG. 7 shows a recess of the clinching roller of FIG. 6.
Figure 8:
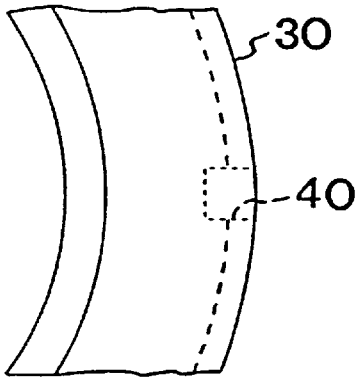
FIG. 8 shows a portion of the clinching roller of FIG. 6 from the side.

A swollen or expanded deformation 41 is shown in more detail in FIG. 4, and the lock-seam 37 is shown in FIG. 5.

Figure 9:
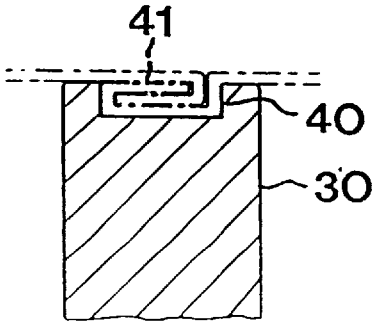
FIG. 9 is a sectional view of the clinching roller of FIG. 6 illustrating a lock-seam indicated by dash-dot lines.

The recess 40 of the clinching roller 30 of the first embodiment is shown in detail in FIGS. 6–9. The recess 40 is broader than the groove 39 with respect to the thickness of the clinching roller 30. The section of FIG. 9 shows the deformation 41 of the lock-seam in the recess 40.

Figure 10:
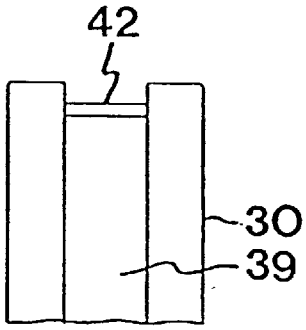
FIG. 10 is a partial view of a second embodiment of a clinching roller.
Figure 12:
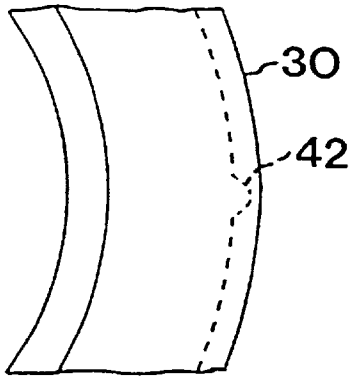
FIG. 12 shows a portion of the clinching roller of FIG. 10 from the side.
Figure 11:
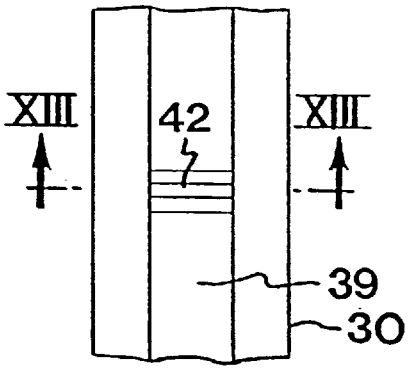
FIG. 11 shows a ridge of the clinching roller of FIG. 10.

Of course, the interlocking deformations of the lock-seam 37 can be achieved in other ways. A second embodiment of the clinching roller 30 is shown in FIGS. 10–12. In this embodiment, there is not a recess, but a transverse ridge 42 in the groove 39. In the clinching point between the rollers 30, 34 (cf. FIG. 2), the ridge 42 is pressed into the lock-seam 37, thereby causing an indentation in the same. The ridge 42 can have the same width as the groove 39.

Figure 13:
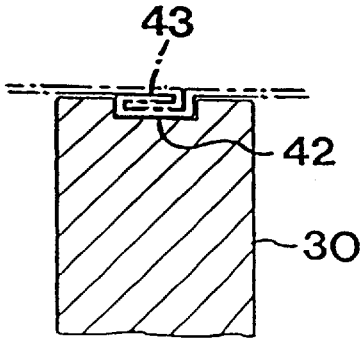
FIG. 13 is a sectional view of the clinching roller of FIG. 10 illustrating a lock-seam indicated by dash-dot lines.
Figure 16:
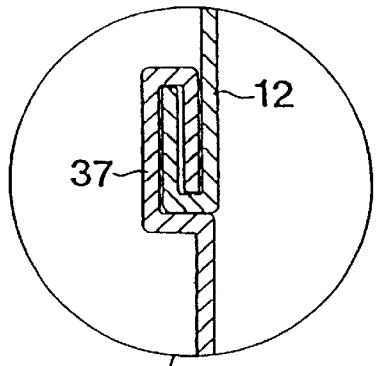
FIG. 16 shows, on a larger scale, a cross-section of the lock-seam shown in FIG. 14.

The section shown in FIG. 13 illustrates how the interlocking deformation 43 of the lock-seam is formed in the groove 39 of the clinching roller 30. The ridge 42 forms an indentation in the lock-seam.

Figure 14:
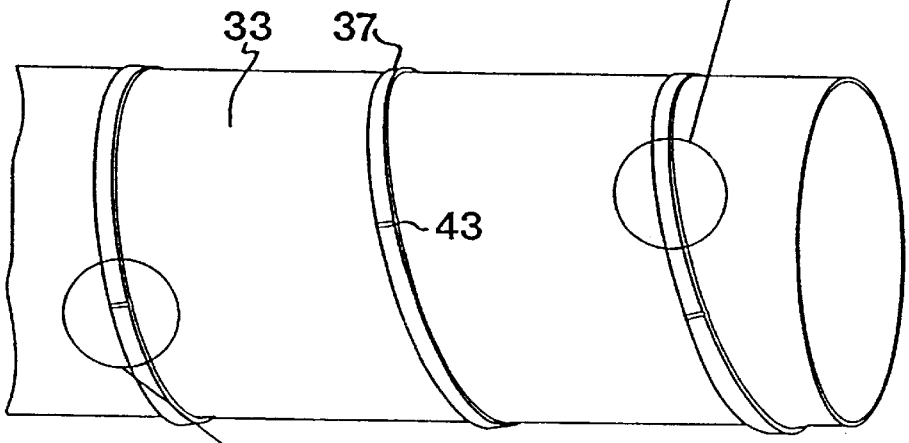
FIG. 14 shows a tube produced by use of a clinching roller of FIG. 10.
Figure 15:
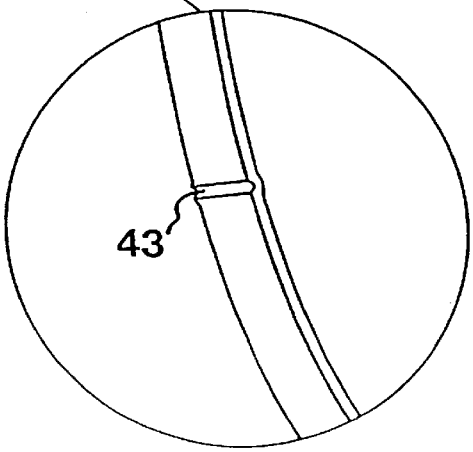
FIG. 15 shows, on a larger scale, the lock-seam of the tube shown in FIG. 14.

FIG. 14 shows a tube 33 with a lock-seam 37 with spaced indentations or deformations 43 formed by a clinching roller according to the second embodiment. FIG. 15 shows such a deformation 43 in detail. The indentation 43 must be so deep that sufficient interlocking between the edge portions in the lock-seam 37 is achieved.

In the two clinching roller embodiments described, it is preferred that at least one interlocking deformation 42, 43 is provided on each helical turn of the lock-seam 37. However, if a very strong interlocking effect is desired, several deformations 42, 43 may be formed on each helical turn.

Figure 17:
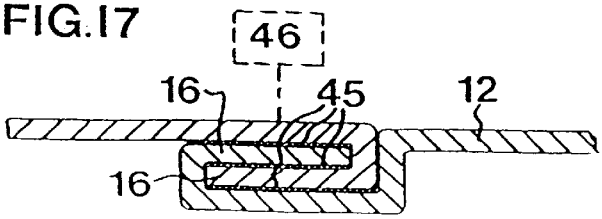
FIG. 17 shows a cross-section of a lock-seam in yet another embodiment of the invention.
Figure 18:
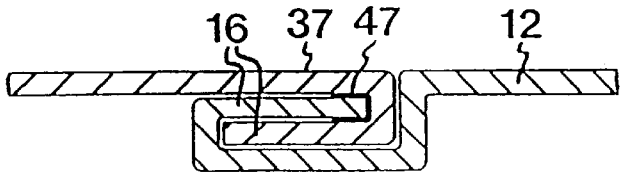
FIGS. 18–22 are cross-sectional views of alternative lock-seams in accordance with the invention.
Figure 19:
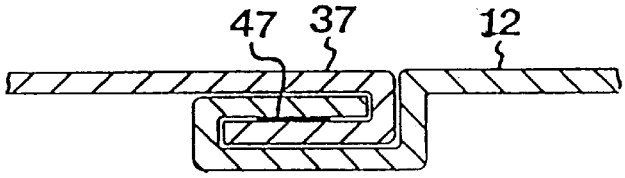
Figure 20:
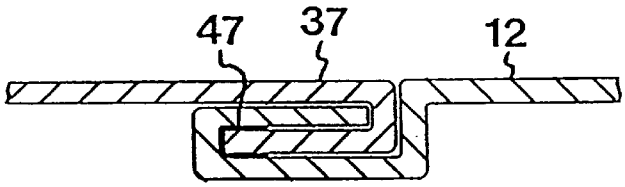
Figure 21:
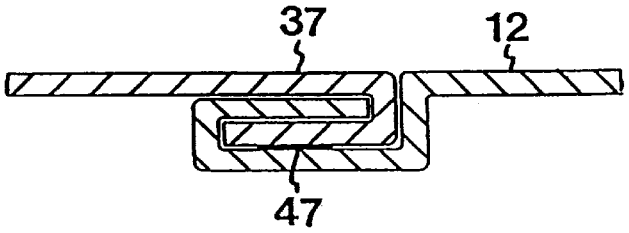
Figure 22:
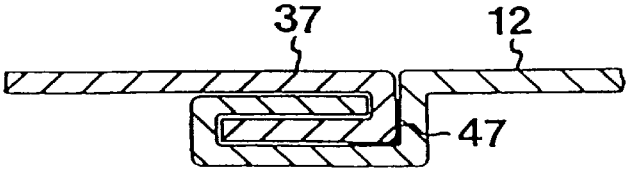

As an alternative to the interlocking deformations 41, 43 described above, the surfaces of the edge portions 16 of the strip 12 can be provided with knurls 45 which are brought into frictional engagement with each other in a clinching operation forming the lock-seam 37. This is shown in FIG. 17. The knurls 45 are formed on the edge portions 16 by a device 46 schematically shown in FIG. 17. The knurling is preferably performed as a preforming operation, such as the rollers 13 in FIG. 1. Such knurling rollers (not shown) may be driven.

Still another aspect of the invention is illustrated in FIGS. 18–22. In this case, a flexible string 47, for example of rubber, is compressed in the lock-seam 37. By appropriate adjustment of the clinching pressure, the string 47 will act as a friction-enhancing element between the hook-shaped edge portions 16 of the strip 12 and thereby provide the interlocking effect. As can be seen, the compressed flexible string 47 can be inserted in different places between the bent edge portions 16.

Since the string 47 is wound throughout the lock-seam 37, extremely good sealing effect can be achieved. The string 47 is inserted in the lock-seam 37 in connection with the forming head 14. Preferably, the string 47 to be inserted is fed from a spool 48 mounted on the machine. The spool 48 is schematically shown in FIG. 1.

Thanks to the frictional effect of the string 47, slippage of the lock-seam can be avoided while securing good sealing at the same time. Preferably, the string 47 has a round cross-section before insertion and compression in the lock-seam.

The insertion of the string 47 can be combined with the interlocking deformations 41, 43 obtained by the clinching rollers 30 described.

ALTERNATIVE EMBODIMENTS

According to the clinching roller embodiments described, the clinching roller is arranged outside the tube, whereas the counter roller is arranged inside the tube. It should be appreciated, however, that the aimed-at indentations or deformations can also be achieved if the clinching roller is arranged inside the tube and the counter roller is arranged outside the tube. The means (for example a recess or a ridge) for providing the interlocking deformations on the lock-seam can be provided on the periphery either of the clinching roller or of the counter roller. Further, there can be more than one such recess or ridge on the clinching roller or the counter roller. The important thing is that the aimed-at interlocking effect on the lock-seam is achieved.

It will also be appreciated that the two clinching roller embodiments can be combined in such a way that a clinching roller is provided with both recesses and ridges of the type shown.

What is claimed is:

1. A helically wound lock-seam tube which is helically formed from a metal strip having longitudinal edge portions which are interlocked in a helical lock-seam, wherein the helically wound lock-seam includes edge portions forced into deforming contact with each other to lock the interlocked edge portions of the strip in the lock-seam and create deforming bulges in the lock-seam, the deforming bulges interspaced by non-deformed portions of the lock-seam.

2. The tube of claim 1, wherein said deforming bulges are sufficiently deep to provide interlocking between the edge portions.

3. The tube of claim 1, wherein the deforming bulges are formed to extend transversely across the lock-seam.

4. The tube of claim 1, wherein each of the deforming bulges comprises an indentation extending through all layers of the lock-seam.

5. The tube of claim 1, wherein at least one of said deforming bulges is provided on each helical turn of the lock-seam.

6. The tube of claim 1, wherein the non-deformed portions have a length along the lock-seam greater than a dimension of each of the deforming bulges along the lock-seam.

7. The tube of claim 1, wherein the deforming bulges are deformed on an exterior surface of the lock-seam.

8. The tube of claim 1, wherein the deformations are substantially equivalent to a width of the lock-seam.

* * * * *